US006860958B2

(12) United States Patent
Swafford et al.

(10) Patent No.: US 6,860,958 B2
(45) Date of Patent: Mar. 1, 2005

(54) WRINKLE REDUCTION ASSEMBLY

(75) Inventors: Steve Swafford, Easley, SC (US); Steve Schwarz, Inman, SC (US); Dan McKamy, Simponville, SC (US); James Mabry, Spartanburg, SC (US); Jeff Walker, Easley, SC (US)

(73) Assignee: Cryovac, Inc., Duncan, SC (US)

( * ) Notice: Subject to any disclaimer, the term of this patent is extended or adjusted under 35 U.S.C. 154(b) by 336 days.

(21) Appl. No.: 10/183,826

(22) Filed: Jun. 27, 2002

(65) Prior Publication Data

US 2004/0000742 A1 Jan. 1, 2004

(51) Int. Cl.[7] ..... B65B 9/10

(52) U.S. Cl. ..... 156/251; 53/133.4; 53/451; 53/552; 156/515

(58) Field of Search ..... 264/175, 263; 425/363, 369, 385; 492/28, 35; 493/467; 226/192; 156/251, 515; 53/133.1, 133.4, 451, 550, 551, 552, 553

(56) References Cited

U.S. PATENT DOCUMENTS

| | | | | |
|---|---|---|---|---|
| 4,458,852 A | | 7/1984 | Calvert et al. | 242/56 A |
| 4,493,548 A | | 1/1985 | Ateya | 355/3 FU |
| 4,552,295 A | | 11/1985 | Smith et al. | 226/195 |
| 4,554,714 A | | 11/1985 | Cho | |
| 4,589,247 A | | 5/1986 | Tsuruta et al. | 53/550 |
| 4,656,818 A | | 4/1987 | Shimoyama et al. | 53/551 |
| 4,768,411 A | | 9/1988 | Su | 83/170 |
| 4,808,010 A | | 2/1989 | Vogan | 383/107 |
| 4,832,186 A | * | 5/1989 | Conrad | 198/840 |
| 5,038,550 A | | 8/1991 | Wirsig et al. | 53/451 |
| 5,727,724 A | | 3/1998 | Dowling | |
| 6,044,752 A | | 4/2000 | Harigaya | 92/163 |
| 6,212,861 B1 | | 4/2001 | Tsuruta | 53/551 |

FOREIGN PATENT DOCUMENTS

| | | | |
|---|---|---|---|
| DE | 1 761 741 | | 2/1971 |
| EP | 0 852 279 A2 | | 7/1998 |
| EP | 1 120 344 A2 | | 8/2001 |
| JP | 5-278904 | * | 10/1993 |
| JP | 9124008 | | 11/1995 |

OTHER PUBLICATIONS

"Removable Spreader Fingers for Vertical Form–Fill–Seal Equipment" 3 pages, Apr., 2002.

English abstract of DE 295 22 327 U1 and full text in German.

English abstract of Japanese Patent Application No. 07097918, publication No. 08268608, publication date Oct. 15, 1996, Toray Ind Inc.

English abstract of Japanese Patent Application No. 57046405, publication No. 58167345, publication date Oct. 3, 1983, I D KK.

* cited by examiner

*Primary Examiner*—Mathieu D. Vargot
(74) *Attorney, Agent, or Firm*—Mark B. Quatt

(57) ABSTRACT

An apparatus for reducing wrinkles in a film includes a first pair of cylindrical rollers including a first roller and a second roller, the first and second roller each in parallel juxtaposed relation to each other, and each having a substantially smooth surface; and a second pair of cylindrical rollers including a third roller and a fourth roller, the third and fourth roller each in parallel juxtaposed relation to each other, and at least one of the third and fourth roller having a chevron pattern disposed on the surface thereof; the first pair of rollers being adjacent to and spaced apart from the second pair of rollers. A method for reducing wrinkles is also disclosed herein.

17 Claims, 5 Drawing Sheets

WRINKLE REDUCTION ASSEMBLY

FIELD OF THE INVENTION

This invention relates to an apparatus and method for reducing wrinkles in a film, especially a tubular film such as a lay flat tubular film.

BACKGROUND OF THE INVENTION

Vertical form/fill/seal (VFFS) packaging systems have proven to be very useful in packaging a wide variety of food and non-food pumpable and/or flowable products. An example of such systems is the ONPACK™ flowable food packaging system marketed by Cryovac/Sealed Air Corporation. The VFFS process is known to those of skill in the art, and described for example in U.S. Pat. No. 4,589,247 (Tsuruta et al), U.S. Pat. No. 4,656,818 (Shimoyama et al.), U.S. Pat. No. 4,768,411 (Su), and U.S. Pat. No. 4,808,010 (Vogan), all incorporated herein by reference in their entirety. In such a process, lay-flat thermoplastic film is advanced over a forming device to form a tube, a longitudinal (vertical) fin or lap seal is made, and a bottom end seal is made by transversely sealing across the tube with heated seal bars. A flowable product is introduced through a central, vertical fill tube to the formed tubular film. The pouch is then completed by sealing the upper end of the tubular segment, and severing the pouch from the tubular film above it. The process can be a two-stage process where the creation of a transverse heat seal occurs at one stage in the process, and then, downstream of the first stage, a separate pair of cooling/clamping means contact the just-formed transverse heat seal to cool and thus strengthen the seal. In some VFFS processes, an upper transverse seal of a first pouch, and the lower transverse seal of a following pouch, are made, and the pouches cut and thereby separated between two portions of the transverse seals, without the need for a separate step to clamp, cool, and cut the seals. A commercial example of an apparatus embodying this more more simplified process is the ONPACK™ 2050A VFFS packaging machine marketed by Cryovac/Sealed Air Corporation.

In some cases, spreader fingers are used commercially on vertical form/fill/seal equipment such as the ONPACK™ 2070A machine. An example is disclosed in Research Disclosure 420056 published Mar. 20, 1999. A removable set of spreader fingers is attached to a support ring, attached in turn to the bottom end of a solids fill tube of an ONPACK™ 2070A vertical form/fill/seal machine, or preferably directly to the fill tube itself. The top ends of the fingers are shaped to allow them to slide through a slot in the support ring or fill tube and, when pivoted down into position, the edges of a slot guide. This supports the fingers, and prevents any unwanted front-to-back movement of the spreader fingers. The top ends of the fingers are forced against the inside of the fill tube and allow the bottom ends of the fingers to be compressed toward the inside of the film tube as required during part of the machine cycle. The spreader fingers can be removed and replaced with fingers of different length, to match different pouch lengths. U.S. Pat. No. 5,038,550 (Wirsig et al.), incorporated herein by reference in its entirety, also discloses at FIG. 5 a pair of spreader fingers used to prepare a tubular film for entry into the space between a pair of sealing jaws. These fingers are typically located above the transverse sealing assembly, but below or at the lower end of the fill tube area of the machine.

Also typical in some VFFS equipment is a pair of squeezing or voiding rollers, e.g. such as shown as reference numeral 15 in FIGS. 1 and 2 of U.S. Pat. No. 6,212,861 (Tsuruta), incorporated herein by reference in its entirety. These rollers, which typically have a smooth, hard rubber or synthetic rubber surface, function to remove fluids, fats, and other food debris from the inside surfaces of the tubular film in an area where a transverse seal is to be made. This allows the transverse seals to be made with less contamination present in the seal area, and results in cleaner and stronger seals. These rollers will typically be disposed on either side of the vertically-sealed tube 48, with appropriate pneumatic or hydraulic means to cycle the pair of rollers towards and away from each other in timed fashion to coincide with the pouch making cycle of the particular machine. The voiding rollers are typically located below the lower end of the longitudinal heat sealing device, and below the lower end of the fill tube that provides food product to the formed pouch, but above the level of the transverse seal bars. Rollers can also be beneficial in that they help flatten the pouch, and form a bottom "stop" to allow for and support the filling of the next pouch in the filling sequence.

Thus, typical of current VFFS equipment is an apparatus with a set of spring steel spreader fingers, below and downstream of which is a set of smooth squeezing rollers.

Unfortunately, the weight of a food product, such as a fluid, inside the pouch being formed in a VFFS system, tends to gather the pouch, thus causing wrinkles immediately after the film advances downwardly from the spreader fingers. The presence of large particulates, such as cubed beef, in close proximity to the longitudinal (vertical) fin or lap seal can also result in wrinkles. The smooth rollers located downstream of the spreader fingers do not alleviate the wrinkle problem.

The presence of such wrinkles can result in defective packages, or at least packages that are unacceptable to the film user or food processor. In certain applications such as retort packaging, any wrinkling of the packaging material, especially of the seal area of the package, is considered unacceptable. This is because the low acid foods typically packaged in retort applications require a hermetic package to avoid food spoilage and ensure a safe food product.

The inventors have found that using a pair of chevron patterned rollers downstream of the pair of smooth rollers removes most of the wrinkles in the tubular film. Alternatively, the chevron patterned rollers can be disposed upstream of the pair of smooth rollers (and downstream of spreader fingers if present), but the improvement in the reduction of wrinkles is less pronounced.

The invention reduces the number of rejects in packages made on VFFS equipment by reducing the percentage of packages with an unacceptable level of wrinkles.

SUMMARY OF THE INVENTION

In a first aspect, an apparatus for reducing wrinkles in a film comprises a first pair of cylindrical rollers comprising a first roller and a second roller, the first and second roller each in parallel juxtaposed relation to each other, and each having a substantially smooth surface; and a second pair of cylindrical rollers comprising a third roller and a fourth roller, the third and fourth roller each in parallel juxtaposed relation to each other, and at least one of the third and fourth roller having a chevron pattern disposed on the surface thereof; wherein the first pair of cylindrical rollers is adjacent to and spaced apart from the second pair of cylindrical rollers.

In a second aspect, a method for reducing wrinkles in a film comprises providing a first pair of cylindrical rollers comprising a first roller and a second roller, the first and second roller each in parallel juxtaposed relation to each other, and each having a substantially smooth surface; and a second pair of cylindrical rollers comprising a third roller and a fourth roller, the third and fourth roller each in parallel juxtaposed relation to each other, and at least one of the third and fourth roller having a chevron pattern disposed on the surface thereof; wherein the first pair of cylindrical rollers is adjacent to and spaced apart from the second pair of cylindrical rollers; and advancing the film such that the film passes first between and in contact with the first roller and the second roller; and then between and in contact with the third roller and the fourth roller.

In a third aspect, a method for reducing wrinkles in a film comprises providing a first pair of cylindrical rollers comprising a first roller and a second roller, the first and second roller each in parallel juxtaposed relation to each other, and each having a substantially smooth surface; and a second pair of cylindrical rollers comprising a third roller and a fourth roller, the third and fourth roller each in parallel juxtaposed relation to each other, and at least one of the third and fourth roller having a chevron pattern disposed on the surface thereof; wherein the first pair of cylindrical rollers is adjacent to and spaced apart from the second pair of cylindrical rollers; and advancing the film such that the film passes first between and in contact with the third roller and the fourth roller; and then between and in contact with the first roller and the second roller.

BRIEF DESCRIPTION OF THE DRAWINGS

The present invention is illustrated by reference to the following drawings, encompassing different views of various embodiments of the invention, wherein.

DETAILED DESCRIPTION OF THE INVENTION

Figure 1:
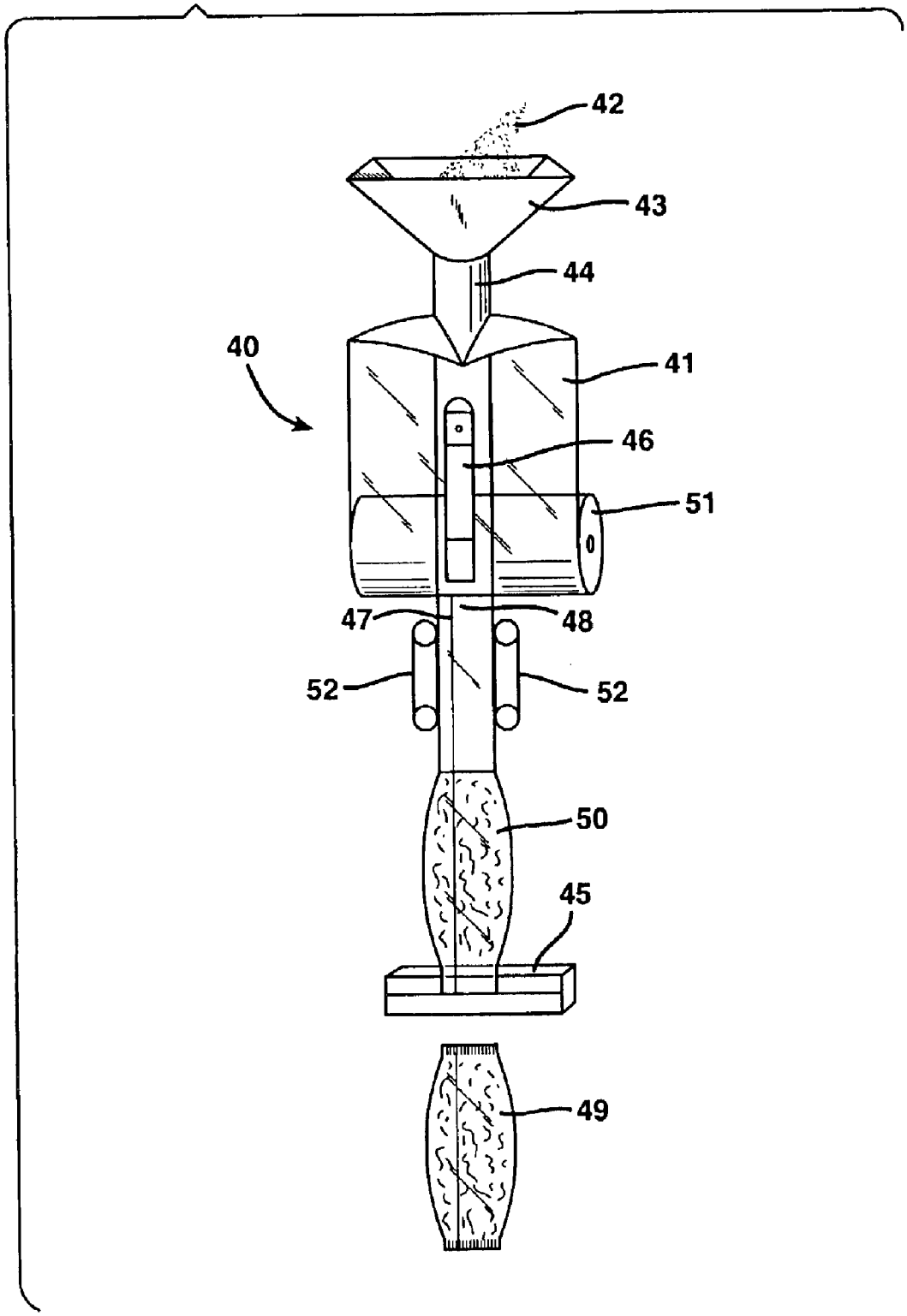
FIG. 1 PRIOR ART
FIG. 1 is an elevational view of a prior art vertical form/fill/seal apparatus for making pouches from layflat rollstock film.

FIG. 1 illustrates a prior art vertical form fill and seal apparatus that can be used in conjunction with the apparatus and process according to the present invention. A vertical form fill and seal apparatus 40 is schematically illustrated. Apparatus 40 utilizes multilayer lay flat film 41 as a rollstock. Product 42, such as cubed beef or other food or non-food product, especially pumpable products, is manually or mechanically supplied to apparatus 40 from a source (not illustrated), from which a predetermined quantity of product 42 reaches the upper end portion of forming tube 44 via funnel 43, or other conventional means. The packages are formed in a lower portion of apparatus 40, and flexible film 41 from which the packages are formed is fed from feed roll 51 over certain forming bars (not illustrated), is wrapped about forming tube 44 (sometimes known as a "sailor's collar" or "forming collar") and is provided with a longitudinal seal 47 by longitudinal heat sealing device 46, resulting in the formation of vertically-oriented tube 48. Transverse heat seal bars 45 operate to close and seal horizontally across the lower end of vertically-sealed tube 48, to form pouch 50 which is thereafter immediately packed with product 42. Film drive belts 52, powered and directed by rollers, as illustrated, advance tube 48 and pouch 50 a predetermined distance, after which end seal bars 45 close and simultaneously seal horizontally across the lower end of vertically-sealed tube 48 as well as simultaneously sealing horizontally across upper end of sealed pouch 49, to form a product packaged in sealed pouch 49. The next pouch 50, thereabove, is then filled with a metered quantity of product 42, forwarded, and the packaging cycle is repeated. It is also conventional to incorporate with the end seal bars a cut-off knife (not shown) which operates to sever a lower sealed pouch 49 from the bottom of upstream pouch 50.

Figure 2:
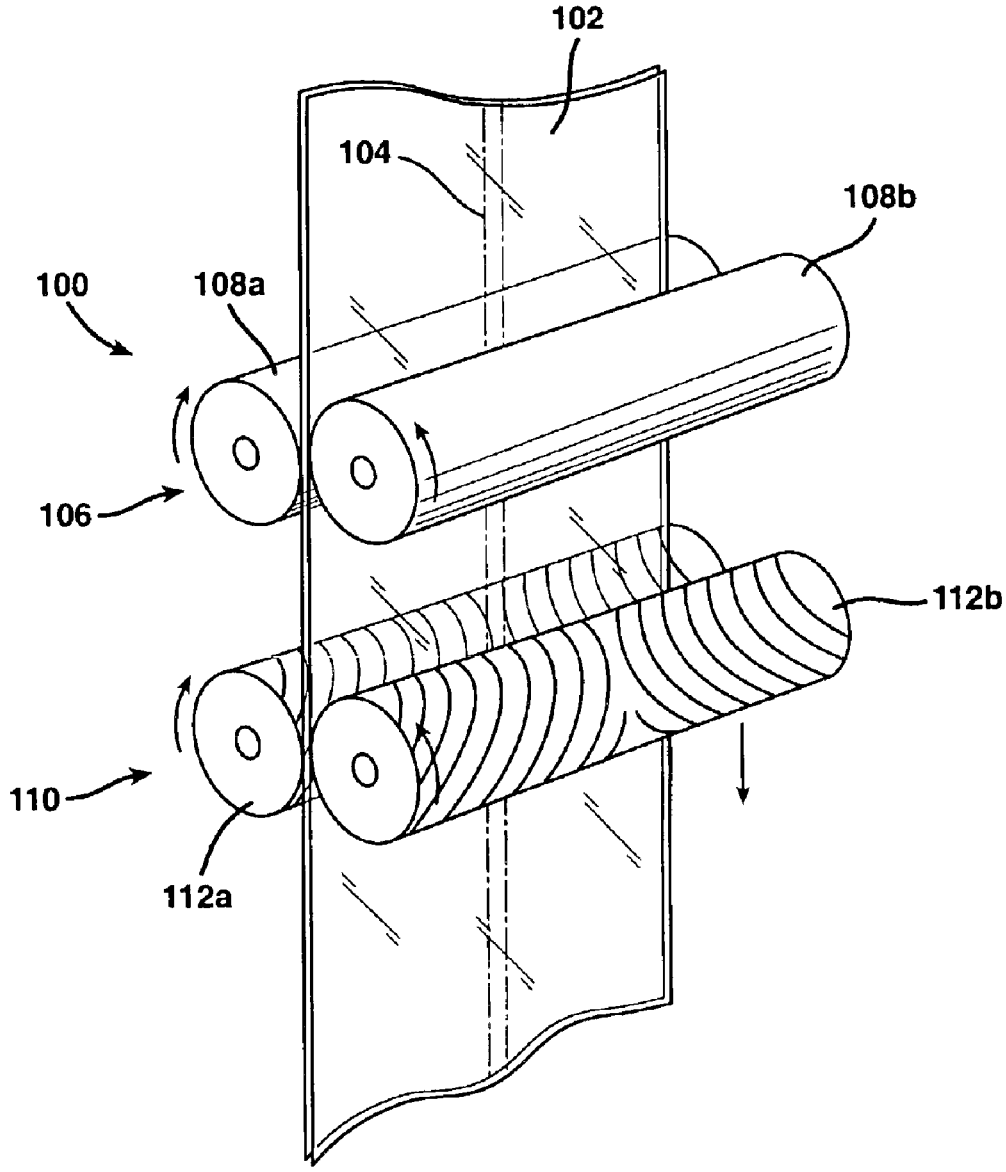
FIG. 2 is a schematic perspective view of the apparatus of the invention.

FIG. 2 is a schematic perspective view of the apparatus 100 of the invention. A lay flat tubular film 102, such as one produced by the VFFS process described above, and having a longitudinal seal 104, is advanced in the direction shown by the arrow between a pair of voiding rollers 106, and then between a pair of chevron patterned rollers 110.

The pair of voiding rollers 106 includes a first roller 108*a* and a second roller 108*b*. These rollers function as described herein to remove fat, liquid and other materials from the inside surfaces of film 102, in preparation for the transverse heat sealing step. Means (not shown), such as a voiding roller assembly, are well known to those of skill in the art for reciprocating the rollers 108*a* and 108*b* from an "open" position in which the rollers are separated from one another and the film, and a "closed" position in which the rollers 108*a* and 108*b* press on the respective outside surfaces of film 102 to accomplish the voiding function. Such means include pneumatic or hydraulic means for swinging or advancing the respective rollers between the open and closed positions, synchronized by appropriate timing means to the machine packaging cycle. Also, electromechanical means, such as a linear actuator or servo motor on a mechanical link, can be used to actuate the movement of the voiding rollers and chevron rollers. Suitable bearing blocks, e.g., are used in conventional equipment to provide for relative movement and support of the voiding rollers. The rollers themselves will have a journaled center on which the support means (not shown) will carry the rollers and permit free rotation of the rollers about their respective axes, in the direction shown by the arrows, when in contact with the advancing film 102.

The pair of chevron patterned rollers 110 include a first roller 112*a* and a second roller 112*b*. It has been found that these rollers function to remove wrinkles that build up in the layflat tubular film 102 during the VFFS process. Means similar to that used for the voiding rollers 106 can be employed for reciprocating the rollers 112*a* and 112*b* from an "open" position in which the rollers are separated from one another and the film, and a "closed" position in which the rollers 112*a* and 112*b* press on the respective outside surfaces of film 102 to accomplish the dewrinkling function. Such means include pneumatic or hydraulic means for swinging or advancing the respective rollers between the open and closed positions, synchronized by appropriate timing means to the machine packaging cycle. The rollers themselves will have a journaled center on which the support means (not shown) will carry the rollers and permit free rotation of the rollers about their respective axes, in the direction shown by the arrows, when in contact with the advancing film 102.

Figure 3:
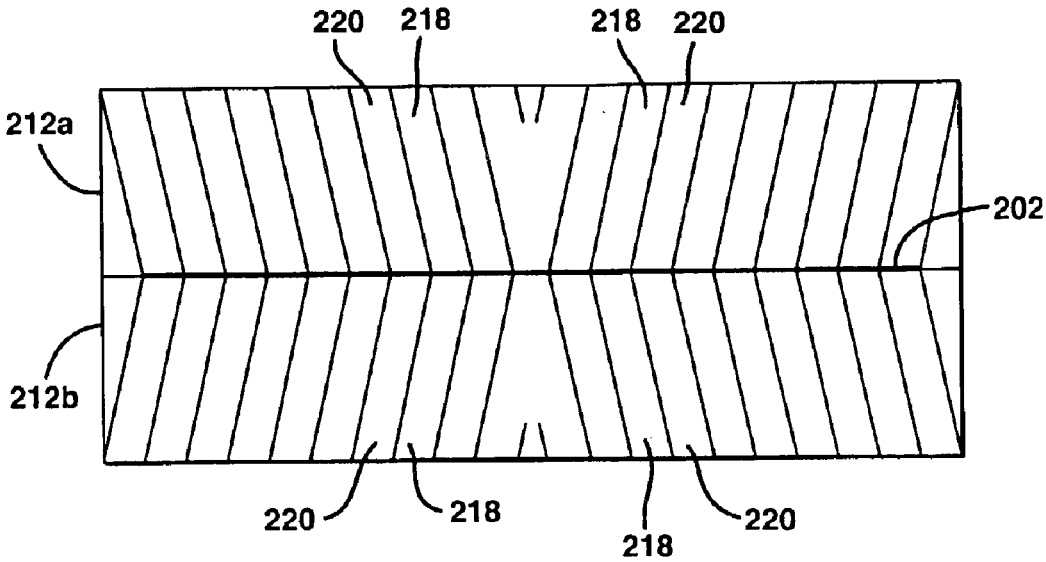
FIG. 3 is a top plan view of a pair of chevron patterned rollers of the invention.

FIG. 3 is a top plan view of a pair of chevron patterned rollers 212*a* and 212*b* of the invention, looking down at the rollers from above. Voiding rollers are not shown for the sake of clarity. Each of the two rollers has a chevron pattern defined by a series of lands 218 and grooves 220 that are arranged in alternating sequence along the length of each roller. These lands and grooves form a helical pattern across the roller, and effect a reduction in wrinkles formed on the film as it passed between these rollers. The visual effect, viewing the rollers when in motion from the point of view of FIG. 3, is that the pattern of lands and grooves moves toward the outer terminus of each respective roller. Thus, when film 202 moves as depicted into the drawing sheet as shown in FIG. 3, the chevron rollers 212*a* and 212*b* will each rotate in a direction toward the longitudinal centerline of the Figure defined by film 202.

Figure 4:
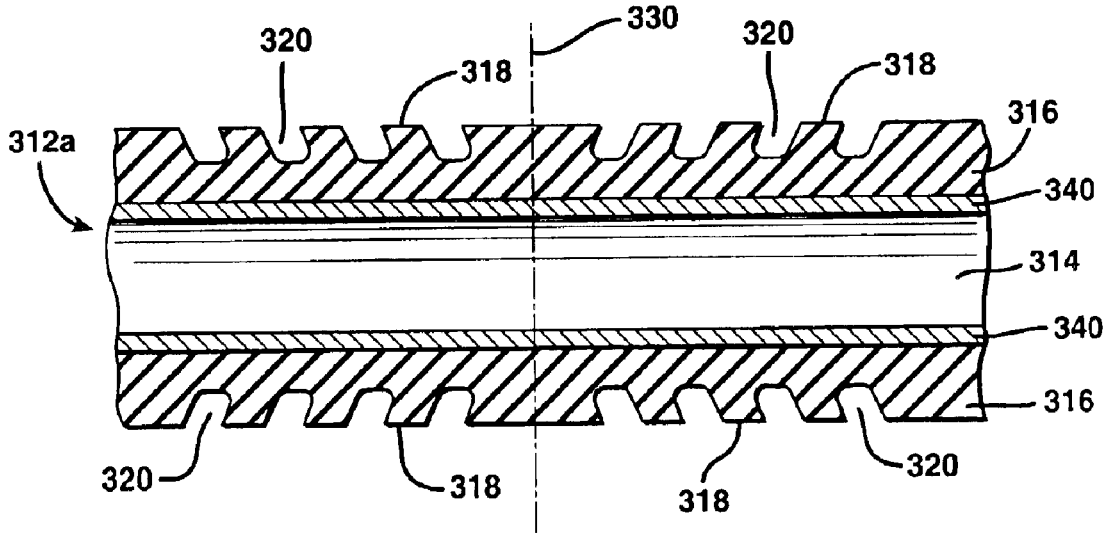
FIG. 4 is a cross sectional view of a portion of a chevron patterned roller of the invention.

FIG. 4 is a cross sectional view of a portion of a single chevron patterned roller of the invention. The roller 312*a* shows an alternating series of lands 318 and grooves 320. In one preferred embodiment, the lands are relatively flat at their outer surface in order to make a smooth and even contact with the lay flat film. The grooves are shown as asymmetric, i.e. their side towards and facing the midline 330 of the roller is relatively flat, but their side toward the lateral extremities of the roller are curved. This is a preferred embodiment, but any suitable geometry of lands and grooves is contemplated provided it will result, when the film is passed between a pair of chevron patterned rollers, in less wrinkles in the film than would be present absent the use of these rollers. The exterior portion 316 of the cylindrical roller can be constructed of any suitable material. Preferred is a natural or synthetic rubber. A hollow cylindrical core 340 can be constructed of any suitable material. Preferred is a relatively stiff and strong material such as metal, especially steel or aluminum, or a hard plastic. The roller 312*a* will have a hollow core 314 to accommodate rods or bearings to facilitate rotation and support of the roller.

Figure 5:
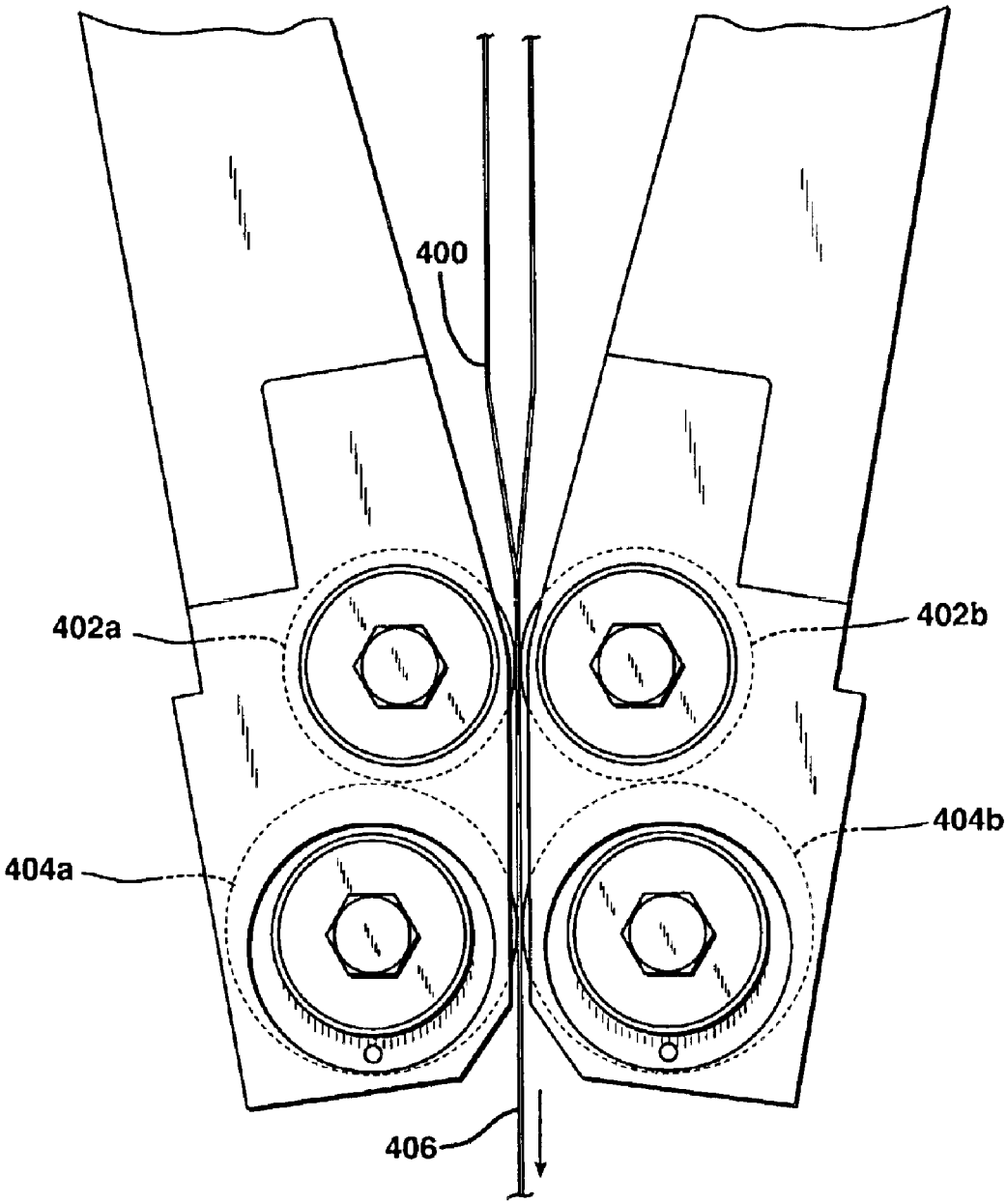
FIG. 5 is a side view of the apparatus of the invention.

FIG. 5 is a side view of the apparatus of the invention. A layflat tubular film 406 passes between a pair of voiding rollers 402*a* and 402*b* and a pair of chevron patterned rollers 404*a* and 404*b*. A spreader finger 400 forms part of a pair of spreader fingers (the other not shown for clarity) which serve to spread the tubular film before it reaches the voiding rollers 402. The direction of the film 406 is indicated by the arrow.

Figure 6:
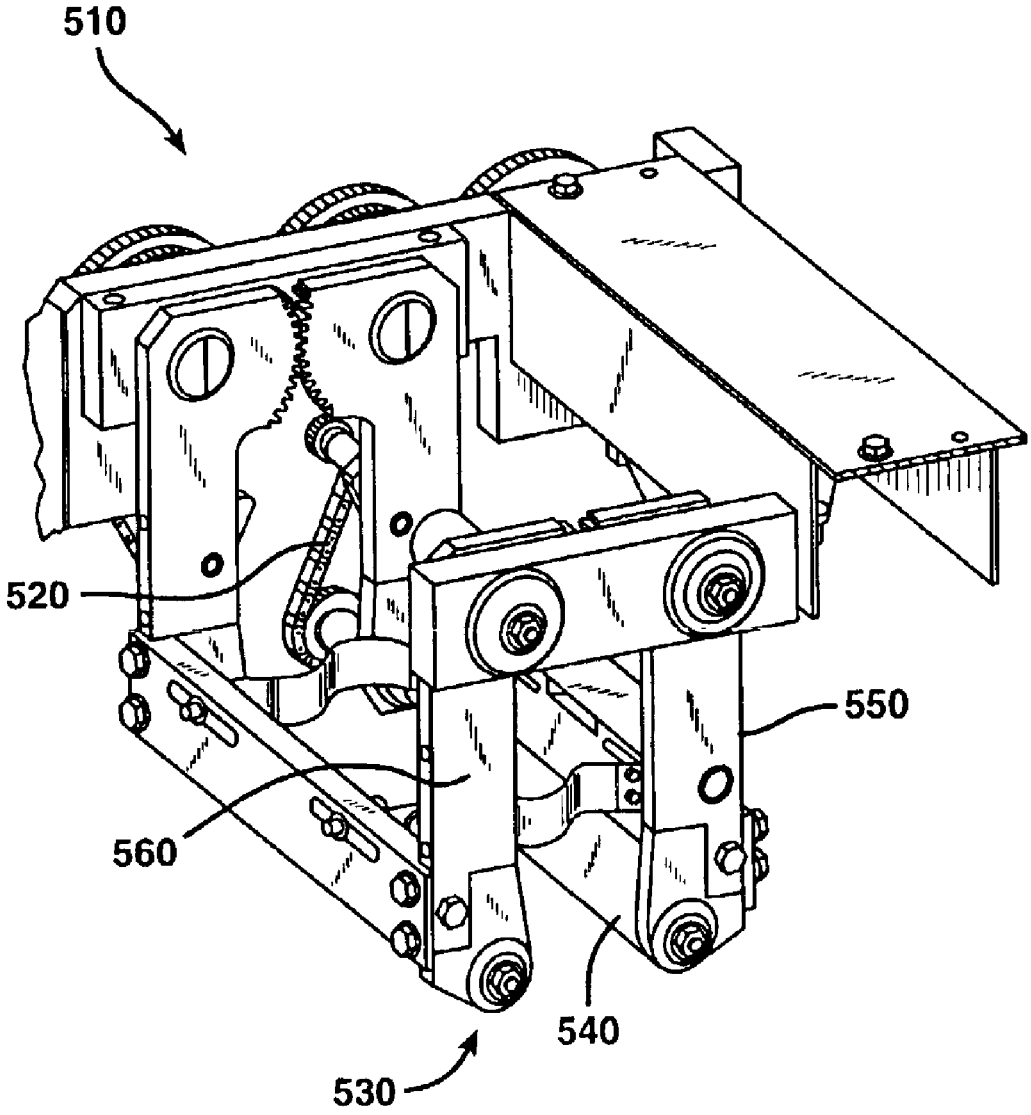
FIG. 6 PRIOR ART
FIG. 6 is a perspective view of a prior art subassembly within which the invention can be mounted.

FIG. 6 is a perspective view of a prior art subassembly 510 within which the invention can be mounted. In the drawing, a chain 520 drives the voiding roller assembly 530. One voiding roller 540 of a typical pair of rollers is shown. The arms 550 and 560 can be cycled toward and away from each other by any suitable means, such as a pneumatic or hydraulic cylinder, or a servomotor or other mechanical linear actuator (not shown for sake of clarity). For purposes of the invention, the arms 550 and 560 can be extended downwardly to accommodate a pair of chevron rollers, as better seen in FIG. 5.

Although the invention has been described primarily as one in which the pair of chevron patterned rollers is downstream of (typically below) a pair of voiding rollers, the reverse arrangement can also provide some benefit. Thus, the pair of chevron patterned rollers can be disposed in a VFFS system upstream of (typically above) a pair of voiding rollers.

Those skilled in the art will also appreciate, after a review of this specification, that a plurality of pairs of either voiding rollers or chevron rollers can be used in series. That is, in one alternative embodiment, a film can be passed sequentially through a pair of chevron patterned rollers, then a pair of voiding rollers, and then another pair of chevron patterned rollers.

In yet another embodiment, an intervening roller, such as a dancer roller, can be disposed intermediate the voiding rollers and chevron rollers, in the event that the invention is used in a packaging system where the voiding rollers and chevron rollers are not in planar arrangement, that is, where the advancing film does not move in a straight line in the space between the voiding rollers and chevron rollers.

The apparatus and process of the invention can be carried out with any appropriate film; preferred are thermoplastic, polymeric films such as those designed for VFFS applications. An example is FS 7055™ film sold by Cryovac/Sealed Air Corporation. Preferably, the film is sealed at the lowest possible temperature at which relatively strong seals are produced. In general, the film is sealed at a temperature of from about 150° C. to 210° C.

The apparatus and process of the invention can be used to package pumpable products, especially food products.

In use, the pressure on the set of chevron patterned rubber rollers, as well as on the voiding rollers, can be adjusted by suitable means.

This package can be made by a continuous or intermittent VFFS pouch making process.

EXAMPLES

Example 1

In a test, an ONPACK™ 2070B vertical/form/fill/seal machine was installed to run beef cubes with brine using two retort-grade thermoplastic films, one of them clear, and the second one white opaque. End seal wrinkles had been prevalent in retort grade packaging applications, and attempts to eliminate them had been unsuccessful. To correct the wrinkle problem, a pair of chevron patterned rollers (rollers with a spiral pattern cut into the surface running from the middle of the rollers towards each of the two respective lateral edges of the roller) along with new bracketry and drive chains were installed on the 2070B equipment, with the new rollers mounted vertically above and spaced apart from a pair of smooth surfaced voiding rollers. The chevron patterned rollers were passively driven, i.e. the chevron rollers did not supply the motive force for advancing the film. The smooth voiding rollers were driven, providing the motive force for advancing the film. It was found that the degree of pressure exerted by the chevron rollers on the film passing between the rollers, when the rollers were brought together and in contact with the film passing between them, was important to proper film advancing.

When the test film was run, it was found that the configuration of the chevron patterned rollers vertically above the driven flat squeeze rollers was found to contribute somewhat, but not a great deal, to reducing the occurrence of wrinkles in the film and final package. A pair of spreader fingers were also present, disposed above the chevron rollers. It was found that the distance between the spreader fingers (305–310 mm) seemed to be an important parameter in reducing wrinkle frequency and severity.

Example 2

A test was conducted like that of Example 1, but in which the roller position was changed to place the pair of smooth voiding rollers above and spaced apart from the pair of chevron patterned rollers. Also, in this test, the chevron patterned rollers were driven, and the smooth voiding rollers were passive. In addition, the voiding rollers did not contact one another when in a closed condition (without the presence of film therebetween), because the diameter of the chevron rollers was much greater than the diameter of the voiding rollers. Without the voiding rollers touching one another, and therefore not exerting a great deal of pressure on a film passed therebetween, seal voiding (removal of residual product from the interior surfaces of the tubular film, in the vicinity of the film to be transversely sealed) by the voiding rollers, was incomplete.

Nevertheless, when the test film was run, the incidence of wrinkles was reduced, although the occurrence of wrinkles was still unacceptably high. It was also confirmed that the distance between the spreader fingers seemed to be an important parameter in reducing wrinkle frequency and severity.

Example 3

Beef chuck roasts were purchased and sliced into cube sizes. The cubes were cooked in boiling water for approximately 30 minutes to get them to the same level of firmness as in the previous tests.

A pair of chevron patterned rollers with a more aggressive (steeper angle, where the direction of the lands and grooves formed a smaller angle with the direction of the longitudinal axis of the roller) spiral pattern on each transverse half of the roller, was installed on the ONPACK™ 2070 machine, in a position vertically below and spaced apart from a pair of smooth surfaced voiding rollers. The chevron patterned rollers were chain driven, while the voiding rollers were passive.

New bracketry was made for the two pairs of rollers, that allowed the voiding rollers to touch one another in the absence of film passing therebetween, and permitting various levels of pressure to be applied to them, and thus to the film, during the film advance. This system greatly reduced the incidence of seal wrinkles compared to the same configuration where the voiding rollers did not touch.

Increasing the pressure on the chevron rollers also had a pronounced effect at reducing wrinkles, compared to relatively light pressure. Sixty-nine packages in a row were run without any end seal wrinkles.

The spreader fingers in this particular configuration were bent in to a distance of 280 mm (from 305 mm) and the packages were still wrinkle free.

It is to be understood that variations and modifications of the present invention may be made without departing from the scope of the invention.

For example, in an alternative embodiment, a chevron patterned roller can be paired with a smooth surfaced roller, e.g. pairing roller 108*a* with roller 112*b*. Such a combination has been found to reduce wrinkles in single wound film passing therebetween, and is expected to provide some improvement in reducing wrinkles in lay flat tubular film. This alternative combination would be practiced in combination with a pair of smooth voiding rollers disposed either upstream or downstream of the alternative chevron roller/smooth roller combination.

Although the invention has been described herein primarily with respect to a pair of smooth rollers in vertical relationship to and spaced apart from a pair of chevron patterned rollers, or a pair made up of a chevron roller and a smooth roller, those skilled in the art will understand that these respective pairs of rollers can have any suitable angle or attitude with respect to one another, and can be associated and disposed in any plane ranging from vertical to horizontal.

Likewise, any suitable chevron pattern can be used, with various, depths of the grooves, spaces between adjacent lands, width of each land, and angle or pitch of the helical arrangement on each transverse half of the chevron patterned roller, as appropriate and effective to effect some degree of wrinkle reduction in film passing between pairs of rollers. The horizontal spacing between lands need not necessarily be constant, and thus the overall pattern on each lateral or transverse half of the roller may not be an exact helix, but may change in angle from the transverse centerline of the chevron roller to each of the two outer lateral edges of the roller. One or more lateral portions of the chevron patterned roller can if suitable be smooth surfaced, so that the chevron pattern appears in one or more bands on the roller.

The present invention can be used for packaging wet flowable and/or pumpable products including low viscosity fluids (e.g. juice and carbonated beverages), high viscosity fluids (e.g. condiments and sauces), fluid/solid mixtures (e.g. soups), gels, etc. Non-food products such as fertilizers, motor oil and engine additives, dry and wet cosmetics, medicaments, medical powders such as foot and talcum powder, sand, cement, and the like can also be beneficially packaged in pouches of the present invention. The present invention finds particular utility in packaging dry flowable and/or pumpable products. These include very finely divided or comminuted products such as flour and cake mixes; somewhat coarser products such as spices and sugar; and even coarser products such as rice and breakfast cereal. Products with larger particulates such as pet food, and non-food dry flowable and/or pumpable products can be beneficially packaged.

"Film" is used herein to mean films, laminates, and webs, either multilayer or monolayer, that may be used in connection with the present invention. The FS laminates, such as FS 7055™, sold by Sealed Air Corporation through its Cryovac Division, are examples of packaging materials suitable for the VFFS process. These laminates are described in e.g. U.S. Pat. No. 4,746,562 (Fant), incorporated herein by reference in its entirety.

An alternative laminate is based on SCLAIR (™) sealant film, an ethylene/alphaolefin copolymer marketed by DuPont Canada, and described in e.g. U.S. Pat. No. 4,521,437 (Storms), incorporated herein by reference in its entirety. A commercial monolayer film from DuPont Canada is FS-3. A commercial multilayer laminate is CL 303. Many other films and laminates useful for dry or wet fluid packaging are available, and can be beneficially used in the present invention.

The present invention can be used in combination with, or as a subsystem of, a variety of equipment systems. A preferred end use is in VFFS applications, for use in such commercially available equipment as ONPACK™ 2070, 2002, and 2050 VFFS packaging equipment. However, those skilled in the art will understand that the invention can be used in other equipment applications, whether for packaging or simply for advancing film e.g. to a wind up roll, where wrinkle reduction is a desired function.

What is claimed is:

1. A vertical form/fill/seal apparatus comprising:

a) a forming tube;

b) a longitudinal heat sealing device;

c) a pair of film drive belts;

d) transverse heat seal bars;

e) a first pair of cylindrical rollers comprising
i) a first roller and
ii) a second roller,
the first and second roller each in parallel juxtaposed relation to each other, and each having a substantially smooth surface; and f) a second pair of cylindrical rollers comprising
i) a third roller and
ii) a fourth roller,
the third and fourth roller each in parallel juxtaposed relation to each other, and at least one of the third and fourth roller having a chevron pattern disposed on the surface thereof;

wherein the first pair of cylindrical rollers is adjacent to and spaced apart from the second pair of cylindrical rollers; and wherein the third and fourth rollers are adapted to accommodate a lay flat tubular film passing between and in contact with the rollers, such that wrinkles present in the film are reduced.

2. The apparatus of claim 1 wherein the first and second rollers, and the third and fourth roller, are freely rotatable about their respective axes.

3. The apparatus of claim 1 wherein the first and second rollers have a smooth external surface.

4. The apparatus of claim 3 wherein the external surface of the first and second roller comprises natural or synthetic rubber.

5. The apparatus of claim 1 wherein the first and second rollers are positioned above the third and fourth rollers.

6. The apparatus of claim 1 wherein the third and fourth rollers are positioned above the first and second rollers.

7. The apparatus of claim 1 wherein the first and second rollers, and the third and fourth rollers, are adapted to cycle between an open position and a closed position.

8. The apparatus of claim 1 wherein at least one of the third and fourth rollers comprises an alternating series of lands and grooves on the surface thereof.

9. The apparatus of claim 1 wherein each of the third and fourth rollers has a chevron pattern disposed on the surface thereof.

10. A method for reducing wrinkles in a film comprising:

a) providing a vertical form/fill/seal apparatus comprising
i) a forming tube;
ii) a longitudinal heat sealing device;
iii) a pair of film drive belts;
iv) transverse heat seal bars;
v) a first pair of cylindrical rollers comprising
(a) a first roller and
(b) a second roller,
the first and second roller each in parallel juxtaposed relation to each other, and each having a substantially smooth surface; and
vi) a second pair of cylindrical rollers comprising
(a) a third roller and
(b) a fourth roller,
the third and fourth roller each in parallel juxtaposed relation to each other, and at least one of the third and fourth roller having a chevron pattern disposed on the surface thereof;
wherein the first pair of cylindrical rollers is adjacent to and spaced apart from the second pair of cylindrical rollers; and b) advancing a lay flat tubular film such that the film passes first between and in contact with the first roller and the second roller; and then between and in contact with the third roller and the fourth roller;
wherein as the film is passed between the third roller and the fourth roller, wrinkles in the film are reduced.

11. The method of claim 10 wherein the first and second rollers, and the third and fourth roller, are freely rotatable about their respective axes.

12. The method of claim 10 wherein the film is advanced in a straight line as it passes first between and in contact with the first roller and the second roller; and then between and in contact with the third roller and the fourth roller.

13. The method of claim 10 wherein each of the third and fourth rollers has a chevron pattern disposed on the surface thereof.

14. A method for reducing wrinkles in a film comprising:

a) providing a vertical form/fill/seal apparatus comprising
i) a forming tube;
ii) a longitudinal heat sealing device;
iii) a pair of film drive belts;
iv) transverse heat seal bars;
v) a first pair of cylindrical rollers comprising
(a) a first roller and
(b) a second roller,
the first and second roller each in parallel juxtaposed relation to each other, and each having a substantially smooth surface; and
vi) a second pair of cylindrical rollers comprising
(a) a third roller and
(b) a fourth roller,
the third and fourth roller each in parallel juxtaposed relation to each other, and at least one of the third and fourth roller having a chevron pattern disposed on the surface thereof;
wherein the first pair of cylindrical rollers is adjacent to and spaced apart from the second pair of cylindrical rollers; and b) advancing a lay flat tubular film such that the film passes first between and in contact with the third roller and the fourth roller; and then between and in contact with the first roller and the second roller;
wherein as the film is passed between the third roller and the fourth roller, wrinkles in the film are reduced.

15. The method of claim 14 wherein the third and fourth rollers, and the first and second rollers, are freely rotatable about their respective axes.

16. The method of claim 14 wherein the film is advanced in a straight line as it passes first between and in contact with the third and fourth rollers, and then between and in contact with the first roller and the second roller.

17. The method of claim 14 wherein each of the third and fourth rollers has a chevron pattern disposed on the surface thereof.

* * * * *